US009031837B2

(12) United States Patent
Homma

(10) Patent No.: US 9,031,837 B2
(45) Date of Patent: May 12, 2015

(54) SPEECH QUALITY EVALUATION SYSTEM AND STORAGE MEDIUM READABLE BY COMPUTER THEREFOR

(75) Inventor: Takeshi Homma, Fuchu (JP)

(73) Assignee: Clarion Co., Ltd., Tokyo (JP)

( * ) Notice: Subject to any disclaimer, the term of this patent is extended or adjusted under 35 U.S.C. 154(b) by 657 days.

(21) Appl. No.: 13/025,970

(22) Filed: Feb. 11, 2011

(65) Prior Publication Data

US 2011/0246192 A1 Oct. 6, 2011

(30) Foreign Application Priority Data

Mar. 31, 2010 (JP) ..... 2010-080886

(51) Int. Cl.
*G10L 21/00* (2013.01)
*G10L 21/02* (2013.01)
*G10L 25/69* (2013.01)

(52) U.S. Cl.
CPC ..... *G10L 25/69* (2013.01)

(58) Field of Classification Search
CPC ..... G10L 19/02; G10L 15/22; H04W 24/00
USPC ..... 704/200.1, 226, 233, 228; 455/67.13, 455/135
See application file for complete search history.

(56) References Cited

U.S. PATENT DOCUMENTS 5,742,929 A * 4/1998 Kallman et al. ..... 704/251
5,848,384 A * 12/1998 Hollier et al. ..... 704/231
6,490,552 B1 * 12/2002 Lee et al. ..... 704/209
6,577,996 B1 * 6/2003 Jagadeesan ..... 704/236
6,609,092 B1 * 8/2003 Ghitza et al. ..... 704/226
6,718,296 B1 4/2004 Beamond et al.
7,016,814 B2 3/2006 Beerends et al.
7,024,362 B2 * 4/2006 Chu et al. ..... 704/260
7,313,517 B2 12/2007 Beerends et al.

(Continued)

FOREIGN PATENT DOCUMENTS

JP 2004/514327 A 5/2004
JP 2004-514327 A 5/2004

(Continued)

OTHER PUBLICATIONS

Telephone Transmission Quality Objective Measuring Apparatus. Objective Measurement of Active Speech Level. International Telecommunication Union. ITU-T, Telecommunication Standardization Sector of ITU. Recommendation p. 56. Mar. 1993.

(Continued)

*Primary Examiner* — Shaun Roberts
(74) *Attorney, Agent, or Firm* — Crowell & Moring LLP

(57) ABSTRACT

In prediction of a speech quality evaluation score such as a phone speech, even when a background noise exists, a subjective opinion score is predicted with high precision. A speech quality evaluation system that outputs a predicted value of the subjective opinion score for an evaluation speech such as a far-end speech of a phone, includes a speech distortion calculation unit that conducts, after calculating frequency characteristics of the evaluation speech, a process of subtracting given frequency characteristics from frequency characteristics of the evaluation speech, and calculates the speech distortion on the basis of the frequency characteristics after the subtracting process has been conducted, and a subjective evaluation prediction unit that calculates the predicted value of the subjective opinion score on the basis of the speech distortion.

12 Claims, 6 Drawing Sheets

(56) References Cited

U.S. PATENT DOCUMENTS

| | | | | |
|---|---|---|---|---|
| 7,366,294 | B2 * | 4/2008 | Chandran et al. | 379/341 |
| 7,881,927 | B1 * | 2/2011 | Reuss | 704/226 |
| 7,890,319 | B2 * | 2/2011 | Garner | 704/200 |
| 8,014,999 | B2 | 9/2011 | Beerends | |
| 2002/0137506 | A1 * | 9/2002 | Matsuoka | 455/425 |
| 2004/0042617 | A1 | 3/2004 | Beerends et al. | |
| 2008/0312918 | A1 * | 12/2008 | Kim | 704/233 |
| 2009/0061843 | A1 * | 3/2009 | Topaltzas | 455/423 |
| 2010/0106489 | A1 | 4/2010 | Bereends et al. | |

FOREIGN PATENT DOCUMENTS

| | | | |
|---|---|---|---|
| JP | 2006-345149 | A | 12/2006 |
| JP | 2008-15443 | A | 1/2008 |
| JP | 2008-513834 | A | 5/2008 |
| WO | WO 2008/119510 | A2 | 10/2008 |

OTHER PUBLICATIONS

Series P: Telephone Transmission Quality. Methods for objective and subjective assessment of quality. Methods for subjective determination of transmission quality. International Telecommunication Union. ITU-T, Telecommunication Standardization Sector of ITU. Recommendation p. 800. Aug. 1996.

Series P: Telephone Transmission Quality. Methods for objective and subjective assessment of quality. Objective quality measurement of telephone-band (300-3400 Hz) speech codecs. International Telecommunication Union. ITU-T, Telecommunication Standardization Sector of ITU. Recommendation p. 861. Aug. 1996.

ETSI EG 202 396-3 V1.2.1. Speech Processing, Transmission and Quality Aspects (ST0); Speech Quality performance in the presence of background noise Part 3: Background noise transmission—Objective test methods. (Jan. 2009).

K.Genuit. Objective evaluation of acoustic quality based on a relative approach. Inter-Noise '96 (1996).

B.C.J.Moore and B.R.Glasberg. Suggested formula for calculating auditory-filter bandwidths and excitation patterns. Journal of the Acoustical Society of America, vol. 74, No. 3, pp. 750-753, Sep. 1983.

Philipos C. Loizou. Speech Enhancement Theory and Practice. CRC Press (2007).

J.G.Beerends and J.A.Stemerdink. A Perceptual Audio Quality Measure Based on a Psychoacoustic Sound Representation. Journal of the Audio Engineering Society, vol. 40, No. 12, pp. 963-978. Dec. 1992.

H.Fastl and E.Zwicker. Psycho-Acoustics. Springer (2006).

J.P.A.Lochner,and J.F.Burger. Form of the Loudness Function in the Presence of Masking Noise. Journal of the Acoustical Society of America, vol. 33, No. 12, pp. 1705-1707, Dec. 1961.

N. Kitawaki and T.Yamada. Subjective and Objective Quality Assessment for Noise Reduced Speech. ETSI Workshop on Speech and Noise in Wideband Communication, May 2007.

T. Yamada et al. Objective Estimation of World Intelligibility for Noise-Reduced Speech. IEICE Trans. Commun., vol. E91-B, No. 12, pp. 40754077, Dec. 2008.

N.Egi et al. Objective Quality Evaluation Method for Noise-Reduced Speech. IEICE Trans. Commun., vol. E91-B, No. 5, pp. 1279-1286, May 2008.

N.R.French and J.C.Steinberg. Factors Governing the Intelligibility of Speech Sounds. Journal of the Acoustical Society of America, vol. 19, No. 1, pp. 90-119, Jan. 1947.

J.G.Beerends and J.A.Stemerdink. A Perceptual Audio Quality Measure Based on a Psychoacoustic Sound Representation. Journal of the Audio Engineering Society, vol. 40, No. 12, pp. 963-978, Dec. 1992.

A.H.Gray,Jr and J.D.Markel. Distance Measure for Speech Processing. IEEE Transactions on Acoustics, Speech, and Signal Processing, vol. ASSP, 24, No. 5, pp. 380-391, Oct. 1976.

A.W.Rix et al. Perceptual Evaluation of Speech Quality (PESQ)—a new method for speech quality assessment of telephone networks and codecs. Proc. ICASSP, pp. 749-752, 2001.

J.G.Beerends and J.A.Stemerdink. A Perceptual Speech-Quality Measure Based on a Psychoacoustic Sound Representation. Journal of the Audio Engineering Society, vol. 42, No. 3, pp. 115-123, Mar. 1994.

Japanese Office Action with Partial English Translation dated Oct. 29, 2013 (five (5) pages).

John G. Beerends et al., "Degradation Decomposition of the Perceived Quality of Speech Signals on the Basis of a Perceptual Modeling Approach", J. Audio Eng., Soc., vol. 55, No. 12, 2007, pp. 1059-1076.

Japanese Office Action dated May 27, 2014, including partial English translation (six (6) pages).

Boll, "Suppression of Acoustic Noise in Speech Using Spectral Subtraction," IEEE Transactions on Acoustics, Speech and Signal Processing, Apr. 1979, pp. 113-120, vol. 27, No. 2.

Telephone Transmission Quality Objective Measuring Apparatus, Objective Measurement of Active Speech Level. International Telecommunication Union. ITU-T, Telecommunications Standardization Sector of ITU. Recommendation p. 56. Mar. 1993.

Series P: Telephone Transmission Quality, Methods for objective and subjective assessment of quality. Methods for subjective determination of transmission quality. International Telecommunication Union. ITU-T, Telecommunication Standardization Sector of ITU. Recommendation P. 800. Aug. 1996.

Series P: Telephone Transmission Quality. Methods for objective and subjective and subjective assessment of quality. Objective quality measurement of telephone-band (300-3400 Hz) speech codecs. International Telecommunication Union. ITU-T, Telecommunications Standardization Sector of ITU. Recommendation p. 861. Aug. 1996.

Series P: Telephone Transmission Quality, Telephone Installations, Local Line Networks. Methods for objective and subjective assessment of quality. Perceptual evaluation of speech quality (PESQ): An objective method for end-to-end speech quality assessment of narrow-band telephone networks and speech codes. International Telecommunication Union. ITU-T, Telecommunication Standardization Sector of ITU. Recommendation p. 862, Feb. 2001.

ETSI EG 202 396-3 V1.2.1. Speech Processing, Transmission and Quality Aspecs (ST0); Speech Quality performance in the presence of background noise Part 3: Background noise transmission-Objective test methods. (Jan. 2009).

K.Genult. Objective evaluation of acoustic quality based on a relative approach. Inter-Noise '96 (1996).

B.C.J. Moore and B.R. Glasberg. Suggested formula for calculating auditory-filter bandwidths and excitation patterns. Journal of the Acoustical Societ of America, vol. 74, No. 3, pp. 750-753, Sep. 1983.

Philipose C. Loizou, Speech Enhancement Theory and Practice. CRC Press (2007).

J.G. Beerends and J.A. Stemerdink. A Perceptual Audio Quality Measure Based on Psychoacoustic Sound Representation. Journal of the Audio Engineering Society, vol. 40, No. 12, pp. 963-978. Dec. 1992.

H. Fastl and E. Zwicker. Psycho-Acoustics. Springer (2006).

J.P.A. Lochner and J.F. Burger. Form of the Loudness Function in the Presence of Masking Noise. Journal of the Acoustical Society of America, vol. 33, No. 12 pp. 1705-1707, Dec. 1961.

* cited by examiner

SPEECH QUALITY EVALUATION SYSTEM AND STORAGE MEDIUM READABLE BY COMPUTER THEREFOR

CLAIM OF PRIORITY

The present application claims priority from Japanese patent application JP2010-080886 filed on Mar. 31, 2010, the content of which is hereby incorporated by reference into this application.

BACKGROUND OF THE INVENTION

1. Field of the Invention

The present invention relates to a speech quality evaluation system that outputs a predicted value of a subjective opinion score for an evaluated speech, and more particularly to a speech quality evaluation system that conducts a speech quality evaluation of a phone.

2. Description of the Related Art

The speech quality evaluation of the phone is generally conducted by psychological experiments by plural evaluators. In a general method taken in the psychological experiments, after one speech sample has been presented to the evaluators, the evaluators select, as a speech quality of the speech sample, one category from categories of about 5 to 9 levels. As an example of the categories, as exemplified by the categories disclosed in ITU-T Recommendation P.800 ("Methods for subjective determination of transmission quality"), one category is selected from five categories having Excellent with 5 points, Good with 4 points, Fair with 3 points, Poor with 2 points, and Bad with 1 point for the speech quality.

However, because the evaluation using the psychological experiments is required to collect a large number of evaluators, there arises a problem that it takes time and costs. In order to address this problem, a technique by which the subjective opinion score is predicted from speech data has been developed.

ITU-T Recommendation P. 862 ("Perceptual evaluation of speech quality (PESQ): An objective method for end-to-end speech quality assessment of narrow-band telephone networks and speech codecs"), and ITU-T Recommendation P. 861 ("Objective quality measurement of telephone band (300-3400 Hz) speech codecs") disclose a technique by which a reference signal (hereinafter referred to as "reference speech") of an evaluation speech and a speech (hereinafter referred to as "far-end speech") heard by the phone are compared with each other to predict a predicted subjective opinion score of the phone speech quality.

ETSI EG 202 396-3 V1.2.1 ("Speech Processing, Transmission and Quality Aspects (STQ); Speech Quality performance in the presence of background noise, Part 3: Background noise transmission-Objective test methods," (2009-01)) discloses a technique by which a predicted value of the subjective opinion score is output by using a speech (hereinafter referred to as "near-end speech") input to a phone on a speaker side as well as the reference speech and the far-end speech. In this method, in order to predict the speech quality of the phone speech and the speech quality of noise, individually, a mean opinion score (SMOS) of the speech quality and a mean opinion score (NMOS) of noise are calculated, and a general mean opinion score (GMOS) is further calculated. In an expression for calculating the mean opinion score of the speech quality, a reduction in the amount of noise between the near-end speech and the far-end speech is used. Also, in K. Genuit ("Objective evaluation of acoustic quality based on a relative approach," InterNoise '96(1996)), which is cited in ETSI EG 202 396-3 V1.2.1 ("Speech Processing, Transmission and Quality Aspects (STQ); Speech Quality performance in the presence of background noise, Part 3: Background noise transmission-Objective test methods," (2009-01)), in prediction of the subjective opinion score, not only a power of speech in each frequency band, but also a temporal variation of the power on every 2-msec duration is calculated.

Japanese Unexamined Application Publication (Translation of PCT) No. 2004-514327 discloses a method of subtracting a physical quantity of echo from a physical quantity of the evaluation speech, in order to consider an influence of echo occurring in the phone for prediction of the subjective opinion score.

BRIEF SUMMARY OF THE INVENTION

When a speaker of the phone is in a situation where noise is large, for example, during driving of an automobile, the noise is mixed with a far-end speech. In order to prevent a speech quality from being deteriorated by the noise, a hands-free system for the automobile is normally provided with a noise suppressing process.

In the phone speech in which the noise exists, there has been known that a score of the speech quality is decreased. However, the noise does not always lead to the deterioration of the speech quality, and even when the noise exists, it may be felt that the speech quality is good. The present invention has been made to develop a technique for predicting a subjective opinion score which can cope with a case in which it is felt that the speech quality is good even when the noise exists.

In the techniques disclosed in the above-mentioned documents "ITU-T Recommendation P. 862" and "ITU-T Recommendation P. 861", in an algorithm for calculation of the subjective opinion score, the subjective opinion score is predicted on the basis of a difference of loudness between a reference speech and a far-end speech at each frequency band. In the techniques, the condition in which the speech quality is good although the noise exists therein is not sufficiently taken into account.

In the technique disclosed in the above-mentioned document "ETSI EG 202 396-3 V1.2.1", a processing for reflecting a reduction in the amount of noise between the near-end speech and the far-end speech on the subjective opinion score is conducted. However, because an influence of the noise on speech is aggregated into one scalar, the influence of the noise at each time is not considered. Also, in the technique disclosed in the above-mentioned document "K. Genuit", although a power variation in a short time of the 2-msec duration is considered, an influence of the noise on the speech, which exists for a long time, such as driving noise during driving of the automobile, is not considered.

In the technique disclosed in Japanese Unexamined Application Publication (Translation of PCT) No. 2004-514327, after the frequency characteristics of an echo signal are subtracted from a speech signal of the far-end speech, the subjective opinion score is predicted. However, this technique cannot be applied to a reduction in an influence of the noise included in the far-end speech per se.

Also, in the above cited documents, a scale for prediction is limited to one scale indicating that "speech quality is good or bad". However, in order to realize the phone speech with higher quality, speech quality evaluation should be conducted from various viewpoints. Hence, it is desirable that the predicted subjective evaluation can cope with plural scales for subjective evaluation.

The present invention aims at providing a speech quality evaluation system and a computer readable medium for the system, which can predict a subjective opinion score of speech with high precision even when noise is mixed into the speech.

In order to achieve this object, according to one aspect of the present invention, there is provided a speech quality evaluation system that outputs a predicted value of a subjective opinion score for evaluation speech, including: a speech distortion calculation unit that conducts a process of subtracting, after frequency characteristics of the evaluation speech are calculated, given frequency characteristics from the frequency characteristics of the evaluation speech, and calculates a speech distortion based on the frequency characteristics after the subtracting process; and a subjective evaluation prediction unit that calculates a predicted value of the subjective opinion score based on the speech distortion.

In the speech quality evaluation system according to another aspect of the present invention, a reference speech which is a reference of evaluation is input, and the speech distortion calculation unit calculates the speech distortion based on a difference between the evaluation speech after the subtracting process and the reference speech.

Also, according to still another aspect of the present invention, the speech quality evaluation system further includes a noise characteristics calculation unit that obtains the frequency characteristics of the evaluation speech in a silence duration, wherein the speech distortion calculation unit uses the frequency characteristics of the evaluation speech in the silence duration as the frequency characteristics used in the subtracting process.

Also, according to still yet another aspect of the present invention, the speech quality evaluation system further includes a noise characteristics calculation unit that obtains the frequency characteristics of a background noise included in the evaluation speech in a speech duration, wherein the speech distortion calculation unit uses the frequency characteristics of the background noise in the speech duration as the frequency characteristics used in the subtracting process.

Also, in the speech quality evaluation system according to still yet another aspect of the present invention, in the speech distortion calculation unit, the frequency characteristics used in the subtracting process are frequency characteristics for subtraction which is input to the speech quality evaluation system.

Also, in the speech quality evaluation system according to still yet another aspect of the present invention, the speech distortion calculation unit conducts the subtracting process by using plural frequency characteristics to calculate plural speech distortions, and the subjective evaluation prediction unit calculates predicted values of one or plural subjective opinion scores based on the plural speech distortions.

Also, the speech quality evaluation system according to still yet another aspect of the present invention further includes plural weighting units each multiplying the frequency characteristics for subtraction by a different weight coefficient, and the speech distortion calculation unit conducts the subtracting process by using the plural frequency characteristics each multiplied by the different weight coefficient.

Also, in the speech quality evaluation system according to still yet another aspect of the present invention, the subjective evaluation prediction unit calculates the predicted values of the plural subjective opinion scores by using a conversion expression with the plural speech distortions as variable.

Also, in the speech quality evaluation system according to still yet another aspect of the present invention, the subtracting process in the speech distortion calculation unit is conducted based on the calculated value of loudness of speech, and conducts calculation so that the loudness of a given frequency characteristic is subtracted from loudness of the evaluation speech.

Also, in the speech quality evaluation system according to still yet another aspect of the present invention, the subtracting process in the speech distortion calculation unit subtracts frequency-power characteristics of noise from frequency-power characteristics of the evaluation speech.

Also, in the speech quality evaluation system according to still yet another aspect of the present invention, the subtracting process in the speech distortion calculation unit subtracts frequency-power characteristics of noise on the Bark scale from frequency-power characteristics of the evaluation speech on the Bark scale.

Also, in the speech quality evaluation system according to still yet another aspect of the present invention, the frequency characteristics used in the subtracting process in the speech distortion calculation unit is frequency characteristics of the evaluation speech in a time duration close to a time to be calculated.

In the speech quality evaluation system according to still yet another aspect of the present invention, the evaluation speech is a far-end speech pronounced from a phone.

A storage medium readably by a computer according to still yet another aspect of the present invention allows a computer to function as the speech quality evaluation system that outputs the predicted value of the subjective opinion score for the evaluation speech.

According to the above aspects of the present invention, in prediction of the subjective opinion score of speech, the prediction can be conducted with high precision for speech into which noise is mixed. Also, according to the above aspects of the present invention, the predicted values of plural scales for subjective evaluation can be calculated.

BRIEF DESCRIPTION OF THE DRAWINGS

Embodiments of the present invention will be described in detail based on the following figures, wherein.

DETAILED DESCRIPTION OF THE INVENTION

Hereinafter, embodiments of the present invention will be described with reference to the accompanying drawings.

In the embodiments, prediction of a subjective opinion score of a far-end speech in a hands-free phone used in an automobile will be described. However, the present invention is not limited to the speech quality evaluation in the hands-free system or a phone system.

(Collection of Speech Quality Evaluation)

Figure 1:
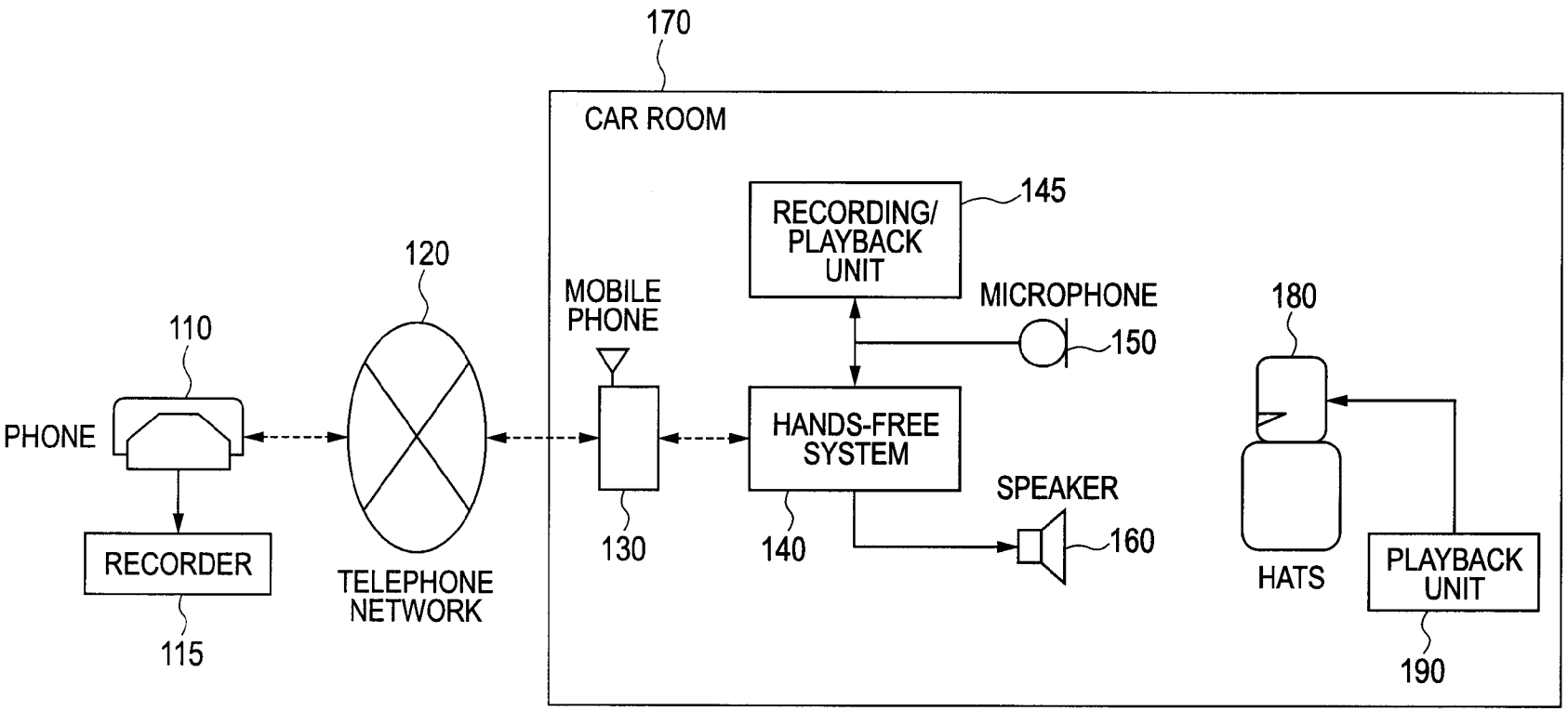
FIG. 1 is a diagram illustrating a configuration for collecting an evaluation speech in a speech quality evaluation of a hands-free phone.

FIG. 1 illustrates a configuration for collecting speech data in prediction of speech quality evaluation of a hands-free phone.

A configuration of a vehicle interior 170 will be described.

First, a head and torso simulator (HATS) 180 is located in a seat. The HATS 180 is configured such that speech is played back from a speaker that simulates lips of a person to simulate acoustic characteristics when the person really speaks. The HATS 180 is connected with a playback unit 190 to play back speech (reference speech) where a language for evaluation is recorded.

A hands-free system 140 is configured to realize a hands-free phone of an automobile. A microphone 150 collects a speech of a person in the automobile, and a speaker 160 plays back a speech of another person who talks about the person in the automobile. In this embodiment, speech played back from the HATS 180 is collected from the microphone 150.

The hands-free system 140 is connected to a mobile phone 130 in a wired or wireless manner to transfer speech information.

The mobile phone 130 and a phone 110 transfer speech through a telephone network 120.

A recorder 115 records speech (far-end speech) transmitted to the phone 110.

With the above units, a procedure of obtaining speech for evaluation will be described.

First, the reference speech is played back by the playback unit 190, and played back by the HATS 180. The speech is transmitted to the microphone 150, the hands-free system 140, the mobile phone 130, the telephone network 120, and the phone 110. The far-end speech is recorded by the recorder 115. In prediction of the subjective evaluation which will be described later, the reference speech and the far-end speech are used.

A series of recording is conducted during driving or stopping of an automobile. During driving, a speech for evaluation played back by the HATS 180 as well as noise occurring during traveling is mixed into the microphone 150. Therefore, noise is also mixed into the far-end speech saved in the recorder 115.

Also, recording of the speech for evaluation is conducted in a silent environment where the automobile is stopping, and speech to which a travel noise collected separately is added is input to the hands-free system 140, with the results that the speech environment during traveling can be simulated. In this method, first during traveling, only the travel noise input to the microphone 150 is recorded by a recording/playback unit 145. Then, during stopping, the speech for evaluation played back from the HATS 180 is recorded by the recording/playback unit 145. Finally, the speech which are added the noise recorded previously with the speech for evaluation are played back by the recording/playback unit 145, and input to the hands-free system 140. As a result, the speech during traveling can be simulated.

In the present specification, the speech input to the hands-free system 140 is called "near-end speech". The near-end speech may be the reference speech played back from HATS and input from the microphone 150, or the speech played back from the recording/playback unit 145.

Also, even when the HATS 180 and the playback unit 190 are not used, speech really generated by a person may be used. When the person speaks really, no reference speech played back from the playback unit 190 exists. In this case, in the silent environment where the automobile is stopping, the person may speak evaluation sentences, and use the near-end speech obtained by recording the speech in the recording/playback unit 145 as the reference speech in the subjective evaluation prediction. In this situation, an acoustic transfer function from a driver in the automobile to the microphone is obtained separately, and frequency characteristics that compensate the acoustic transfer function are applied to the near-end speech. As a result, the sound of the same acoustic characteristics as those of the reference speech played back from the playback unit 190 can be obtained. Alternatively, there may be applied a method in which the near-end speech generated and collected in the silent environment is used as the reference speech as it is, a method in which the near-end speech generated and collected in a travel environment is used as it is, and a method in which speech obtained by an signal processing method from the near-end speech generated and collected in the travel environment is used.

Also, the configuration of FIG. 1 is for evaluation speech creation using a real automobile. Alternatively, the characteristics of the respective units are simulated by acoustic simulation so as to create the respective near-end speech and far-end speech.

First Embodiment

Description of Speech Quality Evaluation System (Preprocessing)

Figure 2:
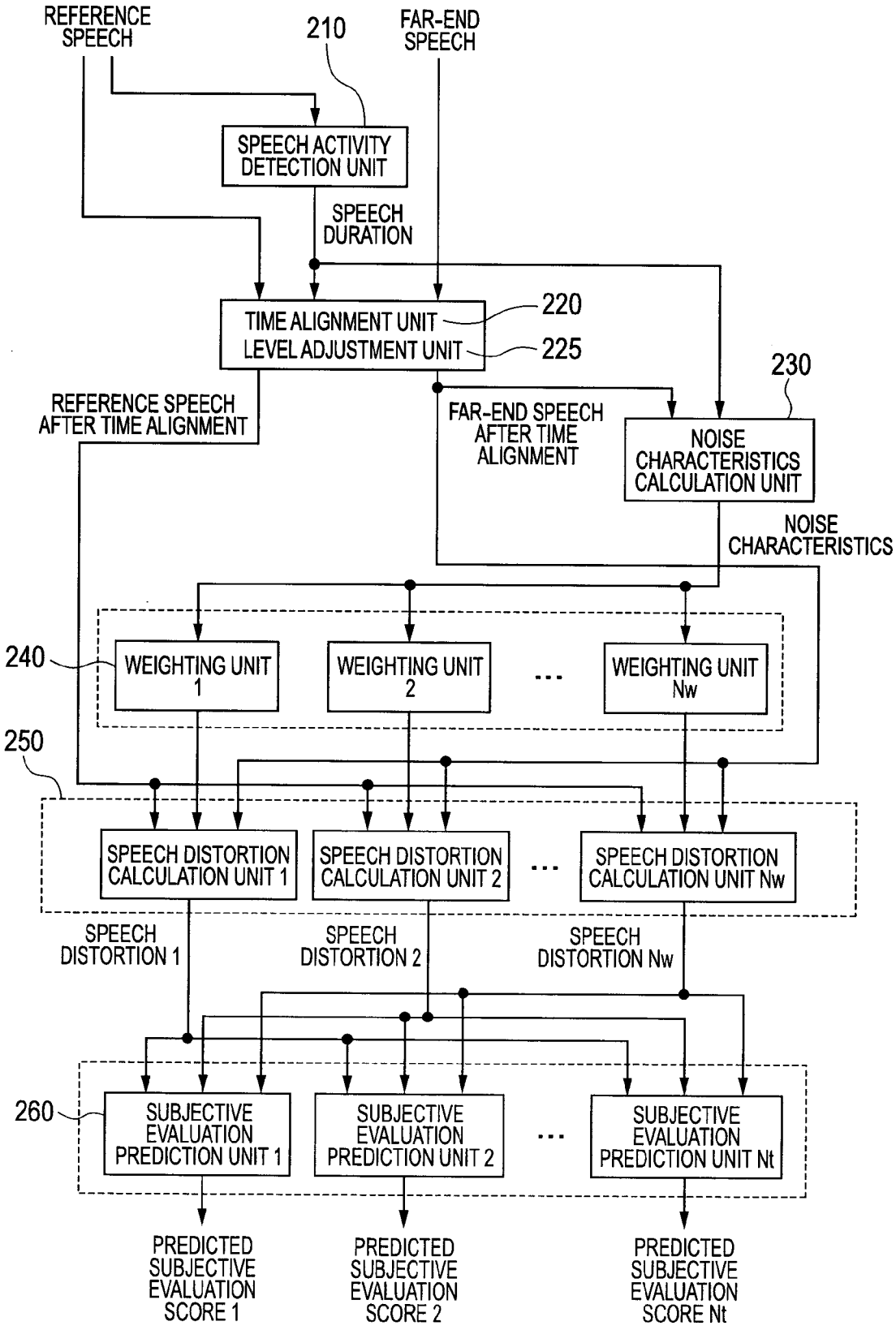
FIG. 2 is a diagram illustrating a block configuration of a speech quality evaluation system according to an embodiment of the present invention.

FIG. 2 is a block diagram illustrating a speech quality evaluation system that inputs a reference speech and the far-end speech which is an evaluation speech, and outputs a predicted value of a subjective opinion score. The speech quality evaluation system includes a preprocessing unit having a speech activity detection unit 210, a time alignment unit 220, a level adjustment unit 225, a noise characteristic calculation unit 230, and a weighting unit 240, as well as a speech distortion calculation unit 250, and a subjective evaluation prediction unit 260. The configuration of the speech quality evaluation system is realized by incorporating a program for speech quality evaluation into a computer or a digital signal processor.

The operation of the speech quality evaluation system will be described with reference to FIG. 2.

The reference speech and the far-end speech are input as digital signals. It is assumed that a format of the digital signal is an uncompressed signal that is 16 kHz in sampling frequency and 16 bits in bit depth. Also, in the following processing, calculation is conducted for each mass (hereinafter referred to as "frame") for analyzing speech data. It is assumed that the number of samples (hereinafter referred to as "frame length") included in one frame is 512 points, and an interval between one frame and a subsequent frame (hereinafter referred to as "frame shift") is 256 points in the number of samples.

The speech activity detection unit 210 specifies in which time duration a speaker speaks, from momentarily sampled values of the reference speech. In the following description, a duration in which the speech is generated is called "speech duration", and a duration in which no speech is generated is called "silence duration". As a method of specifying the speech duration, there can be applied a method in which it is assumed that speech is made when a momentary power (a square value of the sampled value) of each sample of speech is equal to or larger than a set threshold value. A method disclosed in the following document can be used.

ITU-T Recommendation P.56 ("Objective measurement of active speech level"). As a result, one or plural speech duration blocks is specified.

The time alignment unit 220 conducts time alignment between the reference speech and the far-end speech. This alignment is classified into two stages.

In a first stage, a power of each sampled value of the reference speech and a power of each sampled value of the far-end speech are calculated, and a cross-correlation function between powers of those speeches is calculated. The powers are calculated by squaring each sampled value. An amount of time lag where the cross-correlation function becomes the maximum is obtained, and a waveform of the reference speech or the far-end speech is moved by the amount of time lag. In this example, the waveform of the far-end speech is fixed, and only the waveform of the reference speech is moved.

In a second stage, processing is conducted for each block of the speech durations obtained for the reference speech. In each block of the speech durations, a block to each end of which a given silent duration is add is created. Then, for each block of the speech durations of the reference speech, the cross-correlation function with the far-end speech corresponding to the speech duration is calculated, and the amount of time lag where the cross-correlation function becomes the maximum is obtained. A time of each block of the reference speech is moved according to the amount of time lag thus obtained.

The time alignment method is disclosed in detail in the above-mentioned document "ITU-T Recommendation P. 862".

The level adjustment unit 225 adjusts the respective powers of the reference speech and the far-end speech to the same value. In this example, average powers in the speech duration are set to the same value.

First, the powers of the reference speech and the far-end speech in the speech duration are obtained by squaring the respective sampled values in the speech duration obtained from the time alignment unit 220, and averaging the squared sampled values by the number of samples in the speech duration. Then, a coefficient to conform the obtained power to a target value of the average power of speech, which is determined separately, is calculated. It is assumed that the target value of the average power of speech is set to 78 dB SPL according to a value disclosed in the above-mentioned document "ITU-T Recommendation P. 861", and the value corresponds to −26 dB ov on the digital data. [dB ov] is a decibel value converted into 0 dB in the average power of the rectangular waves in the full dynamic range of digital data. The calculated coefficient is multiplied by the respective sampled values of the reference speech and the far-end speech in the entire durations.

Several alternatives of the level adjusting method are proposed. When the method disclosed in the above-mentioned document "ITU-T Recommendation P. 862" is used, the average power in the entire durations is set to the target value for both of those speech waveforms having a narrowed band of 300 Hz or higher in advance. Such another method may be applied.

The noise characteristic calculation unit 230 calculates the frequency characteristics of noise other than speech by using the far-end speech that has been subjected to time adjustment and level adjustment. As this method, any one of a method using speech information in the speech interval, and a method using speech information in the silent interval can be employed, and the respective methods will be described. First, a description will be given of a method of calculating the frequency characteristics of noise based on the information in the silent interval. First, the noise characteristic calculation unit 230 specifies the silent interval on the basis of the speech duration output from the speech activity detection unit 210. The noise characteristic calculation unit 230 calculates frequency-power characteristics (power spectrum) at each time in the silent duration. Although a method of calculating the frequency-power characteristic is known, the method will be described in brief.

First, 512 speech samples for one frame in the silent duration are used, filtered with a Hanning window, and thereafter subjected to fast Fourier transformation. As a result, 512 pieces of data that has been subjected to Fourier transformation is obtained. In the results where the sampled value in an i-th frame is subjected to Fourier transformation, when k-th data is $Y_i[k]$, a power spectrum $Py_i[k]$ is calculated by the following Expression.

$$Py_i[k]=(Re(Y_i[k]))^2+(Im(Y_i[k]))^2 \tag{1}$$

where k is index No. corresponding to the frequency, which is called "frequency bin". Also, i is an index indicative of a frame No.

Then, the frequency-power characteristics in the silent duration are averaged. The power spectrum in each frame in the silent duration is calculated according to Expression (1), and averaged by the number of frames in the silent duration. This is represented by the following Expression.

$$PN[k] = \frac{1}{N_{noise}} \sum_{i \in noise} ((\mathrm{Re}(Y_i[k]))^2 + (\mathrm{Im}(Y_i[k]))^2) \tag{2}$$

where $N_{noise}$ is the number of frames in the silent duration. Also, $i \in noise$ indicates that an addition target is only a frame which is the silent duration. The noise characteristics PN[k] thus obtained is used later.

Also, the following Expression can be used for obtaining the noise characteristics PN[k].

$$PN[k] = \sum_{m=E_f[k]}^{E_l[k]} \left( \frac{1}{N_{noise}} \sum_{i \in noise} ((\mathrm{Re}(Y_i[m]))^2 + (\mathrm{Im}(Y_i[m]))^2) \right) \tag{3}$$

In this expression, when the power of the noise characteristics corresponding to a given frequency is calculated, not only the power of the frequency bin of the frequency is used, but also the power of the frequency bin in the vicinity thereof is added for calculation. $E_f[k]$ and $E_1[k]$ in the expression are first bin No. and final bin No. to be added in calculation of the power of a k-th frequency bin. That is, in calculation of the power of a certain frequency, a value of summing the powers included in the width of the frequency is used. As a reference for defining the width of the frequency, a method based on the width of a critical band filter which exists auditorily is proposed. As a relationship between each frequency and the width of the critical band filter, an equivalent rectangular bandwidth disclosed in the following paper can be used.

B. C. J. Moore, B. R. Glasberg: "Suggested formulae for calculating auditory-filter bandwidths and excitation patterns," Journal of Acoustical Society of America, vol. 74, no. 3, pp. 750-753, 1983

In order to obtain $E_f[k]$ and $E_1[k]$, a frequency corresponding to the frequency bin No. k is calculated, and the equivalent rectangular bandwidth corresponding to the frequency is calculated. Then, a frequency bin No. corresponding to a frequency lower than the frequency corresponding to the frequency bin No. k by half of the equivalent rectangular bandwidth is used as $E_f[k]$, and a frequency bin No. corresponding to a frequency higher than the frequency corresponding to the frequency bin No. k by half of the equivalent rectangular bandwidth is used as $E_1[k]$. It is needless to say that the width of the critical bandwidth filter is not limited by the method described above, but may use a width of a critical bandwidth filter obtained in another method. Also, when the power is added in the critical bandwidth, a weight may be changed according to the respective frequencies.

Now, a method of calculating the frequency characteristic of noise in the speech duration will be described. As a method of estimating the frequency characteristics of a background noise from speech information during speaking, there has been known minimum statistics noise estimation, and minima-controlled recursive averaging (MCRA) algorithm. Those background noise estimating methods are disclosed in detail in a document (P. C. Loizou: "Speech enhancement: Theory and practice," CRC Press, 2007). With the use of those known methods, the power spectrum of the noise corresponding to each frequency bin can be obtained. The obtained power spectrum of noise will be used later as the noise characteristics PN[k].

Also, in obtaining the PN[k], the addition of the powers in the width of the critical bandwidth filter described above may be used.

The calculation of the noise characteristics may be any one of the method using the silence interval and the method using the speech interval, which have been described above. Also, information on the silent interval and the speech interval may be used comprehensively.

Also, unless the noise characteristics to be used later are obtained from the far-end speech, when there are noise characteristics that can be used separately, such noise characteristics are input to the speech quality evaluation system as data, and used as an output value of the noise characteristic calculation unit 230.

The weighting unit 240 multiplies the noise characteristics output from the noise characteristic calculation unit 230 by a weighting coefficient. One weighting unit may be used, but in this embodiment, plural weighting units are assumed. This is used to obtain output values corresponding to plural scales for subjective evaluation by using plural different weights in the subtracting process to be described later.

It is assumed that the number of weighting units is $N_w$. It is assumed that the respective weights of 1, 2, . . . , $N_w$-th weighting units are $\alpha 1, \alpha 2, \ldots, \alpha N_w$. In this case, the noise characteristics PNA[i,k] output by the i-th weighting unit is calculated by the following Expression.

$$PNA[i,k]=\alpha_i PN[k] \tag{4}$$

where k is a frequency bin No.

(Speech Distortion Calculation Unit)

The speech distortion calculation unit 250 calculates the speech distortion by using the reference speech, the far-end speech, and the noise characteristics. The speech distortion calculation units 250 of the number corresponding to the number of the weighting units 240 are prepared.

A processing flow of the speech distortion calculation unit 250 will be described with reference to a flowchart of FIG. 3.

In Step 301, the frequency-power characteristics are calculated from a speech sampled value of the reference speech in each frame.

In Step 302, the frequency-power characteristics are calculated from a speech sampled value of the far-end speech in each frame. Steps 301 and 302 are the same processing. The speech sampled value (512 points) in one frame is multiplied by the Hanning window, and subjected to a fast Fourier transformation to obtain the results of 512 points. Then, the power of each value after the fast Fourier transformation is calculated. This calculation is conducted on the reference speech and the far-end speech in all of the frames.

A description will be given in calculation expressions. When the results of the Fourier transformation of the reference speech in an i-th frame are $X_i[k]$, and the results of the Fourier transformation of the far-end speech are $Y_i[k]$, the power $Px_i[k]$ of the reference speech and the power $Py_i[k]$ of the far-end speech are calculated by the following Expressions.

$$Px_i[k]=((Re(X_i[k]))^2+((Im(X_i[k]))^2 \tag{5}$$

$$Py_i[k]=(Re(Y_i[k]))^2+(Im(Y_i[k]))^2 \tag{6}$$

where k is a frequency bin No.

In Step 303, the frequency-power characteristics of noise output by the weighting unit 240 are subtracted from the frequency-power characteristics of the far-end speech.

The expression will be described. The frequency-power characteristics $Pys_i[k]$ (i: frame No., k: frequency bin No.) of the far-end speech after the subtracting process are calculated by the following Expression.

$$Pys_i[k]=Py_i[k]-PNA[j,k] \tag{7}$$

where j is an index No. of the corresponding weighting unit 240. When calculation is made through Expression (7), the power of the term PNA[j,k] of noise may be larger than the original power of the far-end speech. In this case, the calculation expression is changed so that $Pys_i[k]$ becomes 0 or more, by the following Expression.

$$Pys_i[k]=f_j Py_i[k] \tag{8}$$

where $f_j$ is a value called "flooring coefficient" corresponding to the j-th weighting unit 240. In the description of this embodiment, it is assumed that all of the flooring coefficients fj are 0.01.

As an expression for calculating $Pys_i[k]$, a reference for selecting any one of Expressions (7) and (8) may be a reference other than the above-mentioned one. For example, there is a method in which a value on a right side of Expression (7) is compared with a value on a right side of Expression (8), and a larger value is used as $Pys_i[k]$.

In Step 304, the powers of the reference speech and the far-end speech are normalized.

The expressions will be described. First, the respective average values Tx and Ty of the powers of the reference speech and the far-end speech within the speech duration are calculated by the following Expressions.

$$T_x = \frac{1}{N_{speech}} \sum_{i \in speech} \sum_{k=1}^{N_f} Px_i[k] \tag{9}$$

$$T_y = \frac{1}{N_{speech}} \sum_{i \in speech} \sum_{k=1}^{N_f} Pys_i[k] \tag{10}$$

where $N_{speech}$ is the number of frames within the speech duration, and $N_f$ is the number (512 in this embodiment) of frequency bin after Fourier transformation. Also, i∈speech represents that an addition target is only the frames that are the speech duration.

Then, a target value of the average power of the respective speeches is determined. The target value is determined on the basis of a sound pressure corresponding to a given value of a speech sample. In this example, according to values in the above-mentioned document "ITU-T Recommendation P. 861", it is assumed that the target value of the sound pressure level within the speech duration is 78 dB SPL, and the sound pressure corresponds to −26 dB ov on the speech data. Both of the reference speech and the far-end speech are such that the sound pressure level within the speech duration is −26 dB ov.

It is assumed that the power corresponding to −26 dB ov is $T_{ref}$. Then, both of the reference speech and the far-end speech are normalized so that the average power within the speech duration becomes $T_{ref}$. The frequency-power characteristics of the reference speech and the far-end speech after normalization are represented by $Px'_i[k]$ and $Pys'_i[k]$, respectively. $Px'_i[k]$ and $Pys'_i[k]$ are obtained by the following Expressions.

$$Px'_i[k] = \frac{T_{ref}}{T_x} Px_i[k] \tag{11}$$

$$Pys'_i[k] = \frac{T_{ref}}{T_y} Pys_i[k] \tag{12}$$

In Step 305, the frequency-power characteristics in which a scale of the frequency axis is converted to the Bark scale are calculated from the frequency-power characteristics obtained in Step 304. The Bark scale is a scale calculated on the basis of the pitch perception of a person hearing, which is an axis arranged densely in a low frequency domain and becomes sparser toward the high frequency domain. The method of converting the frequency-power characteristics to the frequency-power characteristics on the Bark scale can use a conversion expression and a constant disclosed in the above-mentioned document "ITU-T Recommendation P. 861". According to the disclosure of "ITU-T Recommendation P. 861", the frequency-power characteristics $Pbx_i[j]$ and $Pbys_i[j]$ of the reference speech and the far-end speech on the Bark scale (i: frame No., j: frame bandwidth No. in the frequency axis on the Bark scale) are calculated by the following Expressions.

$$Pbx_i[j] = S_p \frac{\Delta f_j}{\Delta z} \frac{1}{I_l[j] - I_f[j] + 1} \sum_{k=I_f[j]}^{I_l[j]} Px'_i[k] \tag{13}$$

$$Pbys_i[j] = S_p \frac{\Delta f_j}{\Delta z} \frac{1}{I_l[j] - I_f[j] + 1} \sum_{k=I_f[j]}^{I_l[j]} Pys'_i[k] \tag{14}$$

where $I_f[j]$ and $I_l[j]$ are start No. and end No. of the frequency bin No. corresponding to the j-th frequency band, respectively. $\Delta f_j$ is a frequency width in the j-th frequency band. $\Delta z$ is a frequency width on the Bark scale corresponding to one frequency band. $S_p$ is a conversion coefficient for making a given sampled value to correspond to a given sound pressure.

Also, the frequency-power characteristic obtained in this example can be regarded as a two-dimensional table in which the frame No. i is row, and the frequency band No. j is column. Therefore, the respective elements of $Pbx_i[j]$ and $Pbs_i[j]$ are called "cells".

In Step 306, the frequency-power characteristics of speech are normalized. According to the method disclosed in the above-mentioned document "Recommendation P. 862", a value resulting from adding only the cells having the power higher than a hearing threshold by 1000 times or higher for each frequency band is calculated from the frequency-power characteristics of the reference speech obtained in Step 305. Likewise, a value resulting from adding only the cells having the power higher than the hearing threshold by 1000 times or higher for each frequency band is calculated from the frequency-power characteristics of the far-end speech obtained in Step 305. Then, the added value of the far-end speech in one frequency band is divided by the added value of the reference speech in the same frequency band to obtain a normalization factor related to one frequency band. The normalization factor is calculated in each frequency band. The respective normalization factors are so adjusted as to fall within a given range after calculation. Finally, the value of each cell of the reference speech is multiplied by the normalization factor in the corresponding frequency band. In Step 307, the frequency-power characteristics of speech are smoothed in a time axis direction (frame direction) and in a frequency axis direction. This method may be achieved by a method disclosed in the following document.

J. G. Beerends, J. A. Stemerdink: "A perceptual audio quality measure based on a psychoacoustic sound representation" Journal of the Audio Engineering Society, vo. 40, no. 12, pp. 963-978, 1992

This processing is conducted taking masking characteristics occurring in human hearing in a time direction and a frequency direction into account. In the smoothing in the time direction, when a power exists in a certain cell, a process of adding a value obtained by multiplying the power by a given coefficient to a cell of a subsequent frame is conducted. Also, in the smoothing in the frequency direction, when a power exists in a cell of a certain frequency band, a process of adding a value obtained by multiplying the power by the given coefficient to a cell of an adjacent frequency band is conducted.

Processing in Steps 306 and 307 may be appropriately changed so as to simulate the auditory psychological characteristics according to the scale for subjective evaluation to be obtained.

Also, it is assumed that the respective frequency-power characteristics of the reference speech and the far-end speech, which have been changed through the processing of Steps 306 and 307, are represented as $Pbx'_i[j]$ and $Pbys'_i[j]$ (i: frame No., j: frequency band No.).

In Step 308, the respective loudness densities of the reference speech and the far-end speech are calculated. The loudness density is such that the powers saved in the respective cells of the frequency-power characteristics obtained by a series of calculation in Steps 305, 306, and 307 are converted to a unit [sone/Bark] of loudness which is a unit of loudness subjectively felt by the person. The conversion expression between the power and the loudness density can be applied by expressions disclosed in the above-mentioned documents "ITU-T Recommendation P. 862" and "ITU-T Recommendation P. 861". The respective loudness densities $Lx_i[j]$ and $Ly_i[j]$ of the reference speech and the far-end speech corresponding to a cell of the i-th frame and the j-th frequency band are represented by the following Expressions.

$$Lx_i[j] = S_l\left(\frac{P_0[j]}{0.5}\right)^{\gamma}\left(\left(0.5 + 0.5\frac{Pbx'_i[j]}{P_0[j]}\right)^{\gamma} - 1\right) \tag{15}$$

$$Ly_i[j] = S_l\left(\frac{P_0[j]}{0.5}\right)^{\gamma}\left(\left(0.5 + 0.5\frac{Pbys'_i[j]}{P_0[j]}\right)^{\gamma} - 1\right) \tag{16}$$

where $P_0[j]$ is a power that represents the hearing threshold in the j-th frequency band. γ is a constant indicative of the degree of increment of loudness, and uses 0.23 according to a value examined by Zwicker et al (disclosed by H. Fastl, E. Zwicker: "Psychoacoustics: Facts and Models, 3rd Edition", Springer (2006)). $S_1$ is a constant set so that the loudness densities $Lx_i[j]$ and $Ly_i[j]$ become a unit [sone/Bark]. When each calculated result of the loudness density is negative value, the calculated result is set to 0.

In Step 309, a difference in the loudness density between the reference speech and the far-end speech for each frame is calculated. This is called "loudness difference". A loudness difference $D_i$ of the i-th frame is calculated by the following Expression.

$$D_i = \sum_{j=1}^{N_b} (|Ly_i[j] - Lx_i[j]|\Delta z) \tag{17}$$

where $N_b$ is the number of frequency bands on the Bark scale. Δz is a frequency width on the Bark scale corresponding to one frequency band. That is, a difference of the loudness density between the reference speech and the far end speech in each frequency band is calculated, which is calculated as a total value.

In Step 310, an average value of the loudness difference within the speech duration is obtained from the loudness difference in each frame, which is obtained in Step 309. When a value to be obtained is $D_{total}$, the value is calculated by the following Expression.

$$D_{total} = \frac{1}{N_{speech}} \sum_{i \in speech} D_i \tag{18}$$

The meanings of the respective symbols have been already described, and their description will be omitted. The amount $D_{total}$ obtained here is called "speech distortion".

The processing in Steps 309 and 310 can be achieved by several different calculating methods depending on what auditory psychological phenomenon is focused. In a process of calculating the difference in the loudness density in Step 309, there can be applied (1) a method in which when the difference of the loudness between the reference speech and the far-end speech is smaller than a given threshold value, an addition value is set to 0, (2) a method in which the difference in the loudness between the reference speech and the far-end speech is calculated, and a value multiplied by an asymmetric coefficient that changes according to a magnitude relation of the reference speech and the far-end speech is used, and (3) a method in which averaging using a higher order norm is used instead of simple averaging. The method using the higher order norm will be described in more detail. When it is assumed that the norm order is p, the p-th power of the difference in the loudness density in each frequency band is averaged, and the p-th root of the average value is obtained. The calculated results can be used as the loudness difference $D_i$ in each frame. Also, in the processing of Step 310, there can be applied (1) a method in which averaging using the higher order norm of the loudness difference in each frame is used instead of the simple averaging of the loudness difference in each frame, (2) a method in which not only the loudness difference within the speech duration but also the loudness difference within the silent duration is added, and (3) a method in which a larger weight is given the loudness difference at a later time.

In Step 311, the speech distortion calculated by Step 310 is output to the subjective evaluation prediction unit 260.

(Subjective Evaluation Prediction Unit)

The subjective evaluation prediction unit 260 calculates predicted values of the subjective opinion scores corresponding to one or plural scales for subjective evaluation by using the speech distortion output by one or plural speech distortion calculation units 250.

First, the scales for subjective evaluation will be described. The speech quality of a phone speech can be evaluated from not only the good or bad total speech quality, but also from plural viewpoints. Referring to the above-mentioned document "ITU-T Recommendation P.800" that discloses the subjective evaluation method of the phone speech quality, there are plural scales for subjective evaluation mentioned below.

Listening-quality scale
Listening-effort scale
Loudness-preference scale
Noise disturbance
Fade disturbance In evaluation of those respective scales, it is conceivable that an evaluator pays attention to the aspect of speech different in the respective scales for evaluation. In the embodiment of the present invention described above, an influence of the background noise on the far-end speech is reduced to obtain the speech distortion closer to a feeling of the person. However, when the scales for evaluation are different, it is conceivable that the degree of the influence of the noise is also different. Hence, it is conceivable that reductions in the noise suitable for the respective scales are different.

Also, in prediction of the subjective opinion score of a certain evaluation scale, not only one amount but also plural different amounts are combined together for prediction. As a result, a value closer to the subjective opinion score of the person can be calculated.

Under the circumstance, the plural speech distortions are calculated by the different noise reduction, and associated with the plural scales for subjective evaluation. Also, two or more speech distortions are used in combination to obtain a certain subjective opinion score.

Hereinafter, a method of calculating the predicted values of the plural scales for subjective evaluation by one distortion or the combination of the plural distortions will be described.

It is assumed that the number of scales for subjective evaluation to be predicted is $N_t$. The predicted subjective evaluation scores for the respective evaluation scales are set to $U_1$, $U_2$, . . . , $U_{Nt}$. Also, the speech distortions output by the respective speech distortion calculation units are set $D_1$, $D_2$, . . . , $D_{Nw}$.

The i-th subjective opinion score $U_i$ is calculated by the following Expression.

$$U_i = \alpha_{i,0} + \sum_{j=1}^{Nw} \sum_{k=1}^{2} (\alpha_{i,j,k} D_j^k) \tag{19}$$

That is, the i-th subjective opinion score $U_i$ is represented by a second-order polynomial function with the speech distortion as a variable. $a_{i,0}$ is a constant term, $a_{i,j,k}$ is a coefficient corresponding to a k-order term of the speech distortion $D_j$ output by a j-th speech distortion calculation unit. It is assumed that the respective coefficients $a_{i,0}$ and $a_{i,j,k}$ of this expression are found in advance. That is, it is assumed that a subjective evaluation experiment is conducted by one or plural evaluators on the scales for subjective evaluation, to which attention is paid, and the respective coefficients are obtained so as to fit the expression to the evaluation data under the condition of the reference speech and the far-end speech which have been used in the experiment, in advance.

In this example, the subjective opinion scores are obtained by the second-order polynomial function, however, other functions such as higher-order polynomial functions, logarithmic functions or power functions may be used.

Through the above calculations, the predicted subjective evaluation scores corresponding to the plural scales for subjective evaluation can be obtained.

Second Embodiment

In the above-mentioned first embodiment, the method of subtracting the frequency-power characteristics of the noise from the frequency-power characteristics of the far-end speech has been described. However, in the subtracting process, another method can be applied.

(Subtraction on the Bark Scale)

Figure 4:
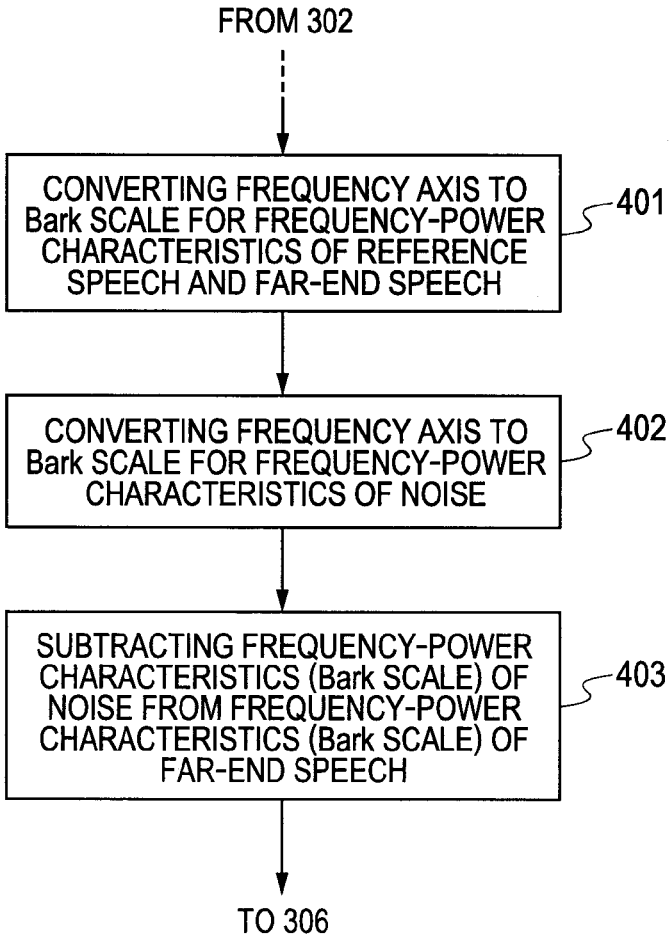
FIG. 4 is a diagram showing a processing flow of a speech distortion calculation unit according to a second embodiment of the present invention.

FIG. 4 shows a method of conducting the subtracting process on the basis of the frequency-power characteristics after having been converted to the Bark scale. A method of calculating the speech distortion through this method will be described.

Figure 3:
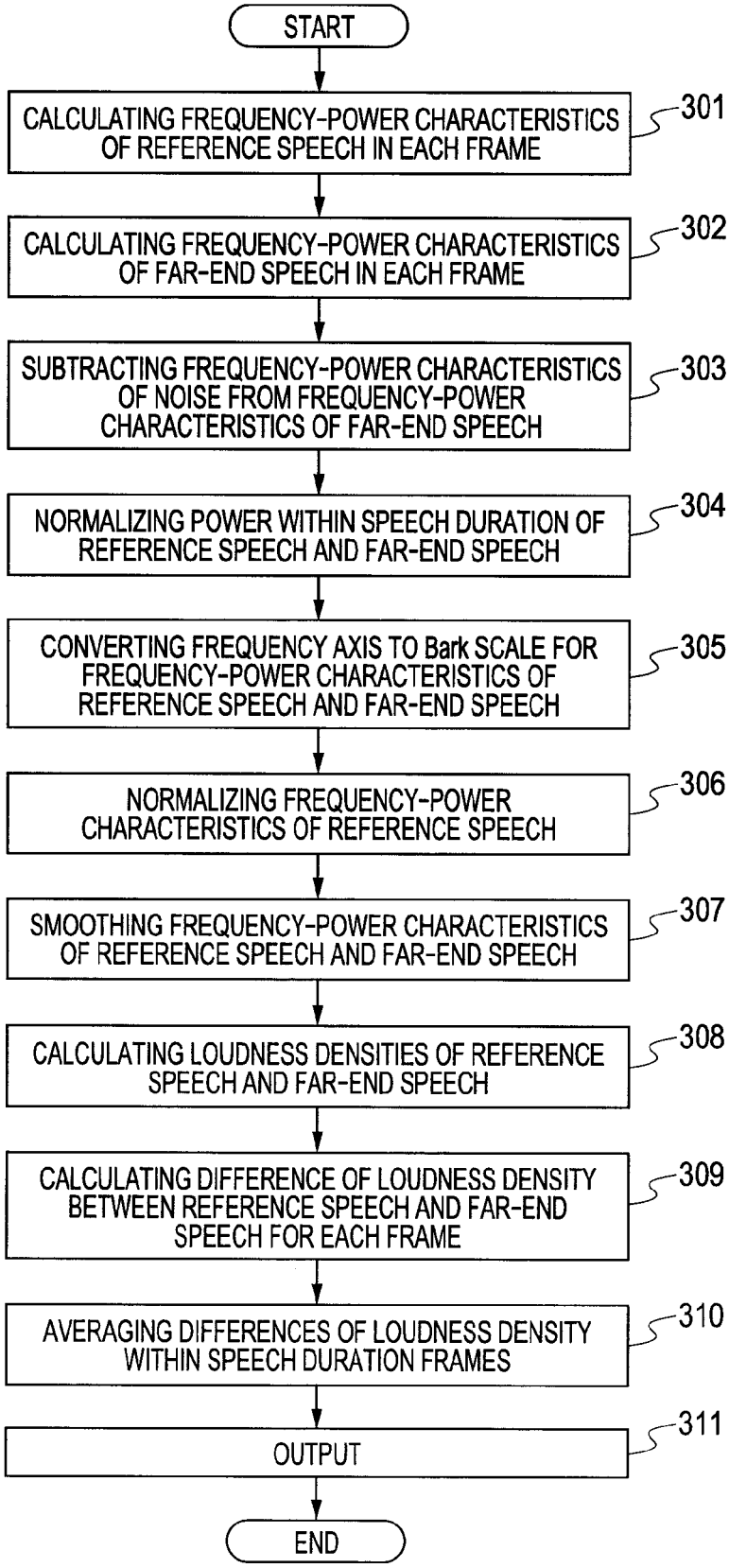
FIG. 3 is a diagram showing a processing flow of a speech distortion calculation unit according to a first embodiment of the present invention.

The initial processing is identical with that in Steps 301 and 302 of FIG. 3, and their description will be omitted.

In Step 401, the frequency axis of the reference speech and the far-end speech for the respective frequency power characteristics obtained in Steps 301 and 302 is converted to the Bark scale. This method is identical with the method described in Step 305 of FIG. 3. First, the frequency-power characteristics $Pbx_i[j]$ and $Pby_i[j]$ (i: frame No., j: frequency band No.) of the reference speech and the far-end speech on the Bark scale are calculated by the following Expression.

$$Pbx_i[j] = S_p \frac{\Delta f_j}{\Delta z} \frac{1}{I_l[j] - I_f[j] + 1} \sum_{k=I_f[j]}^{I_l[j]} Px_i[k] \tag{20}$$

$$Pby_i[j] = S_p \frac{\Delta f_j}{\Delta z} \frac{1}{I_l[j] - I_f[j] + 1} \sum_{k=I_f[j]}^{I_l[j]} Py_i[k] \tag{21}$$

In Step 402, the frequency axis of the frequency-power characteristics of the noise, which is output by the weighting unit 240 through the noise characteristic calculation unit 230, is converted to the Bark scale. This calculating method can be performed by the method of Expression (13), and PbNA[i,j] corresponding to the i-th weighting unit and the j-th frequency band is calculated by the following Expression.

$$PbNA[i, j] = S_p \frac{\Delta f_j}{\Delta z} \frac{1}{I_l[j] - I_f[j] + 1} \sum_{k=I_f[j]}^{I_l[j]} PNA[i, k] \tag{22}$$

The calculating method of Expression (22) can be changed to a method taking the critical band filter into account. First, a center frequency of the j-th frequency band is obtained, and a width of the critical band filter corresponding to the center frequency is calculated. It is assumed that the width is represented by $\Delta f'_j$. In this calculation, the equivalent rectangular bandwidth described above can be used. Then, a frequency lower than the center frequency by half of the equivalent rectangular bandwidth is obtained (start frequency), and a frequency higher than the center frequency by half of the equivalent rectangular bandwidth is obtained (end frequency). Then, the respective frequency bin Nos. corresponding to the start frequency and the end frequency are obtained, and represented by $I'_f[j]$ and $I'_l[j]$. Finally, in Expression (22), $\Delta f_j$, $I_f[j]$, and $I_l[j]$ are replaced with $\Delta f'_j$, $I'_f[j]$, and $I'_l[j]$, respectively, for calculation.

In Step 403, the frequency-power characteristics of the noise on the Bark scale, which have been calculated in Step 402, are subtracted from the frequency-power characteristics of the far-end speech on the Bark scale. The frequency-power characteristics $Pbys_i[k]$ (i: frame No., k: frequency band No.) of the far-end speech after the subtracting process is calculated by the following Expression.

$$Pbys_i[k] = Pby_i[k] - PbNA[j,k] \tag{23}$$

where when Expression (23) is a negative value, the following Expression is used for calculation.

$$Pbys_i[k] = f_j Pby[k] \tag{24}$$

where $f_j$ is a flooring coefficient corresponding to the j-th weighting unit 240.

As an expression for calculating $Pbs_i[k]$, a criterion for selecting any one of Expressions (23) and (24) may be a criterion other than the above-mentioned one. For example, there is a method in which a value on a right side of Expression (23) is compared with a value on a right side of Expression (24), and a larger value is used as $Pbs_i[k]$.

Returning to Step 306 in FIG. 3 after Step 403, the processing is continued.

According to this modification, a reduction in the noise influence which more matches the feeling of the person is conducted for the purpose of subtracting the power of noise in a state where the frequency-power characteristics have been converted to the Bark scale in advance.

Third Embodiment

Figure 5:
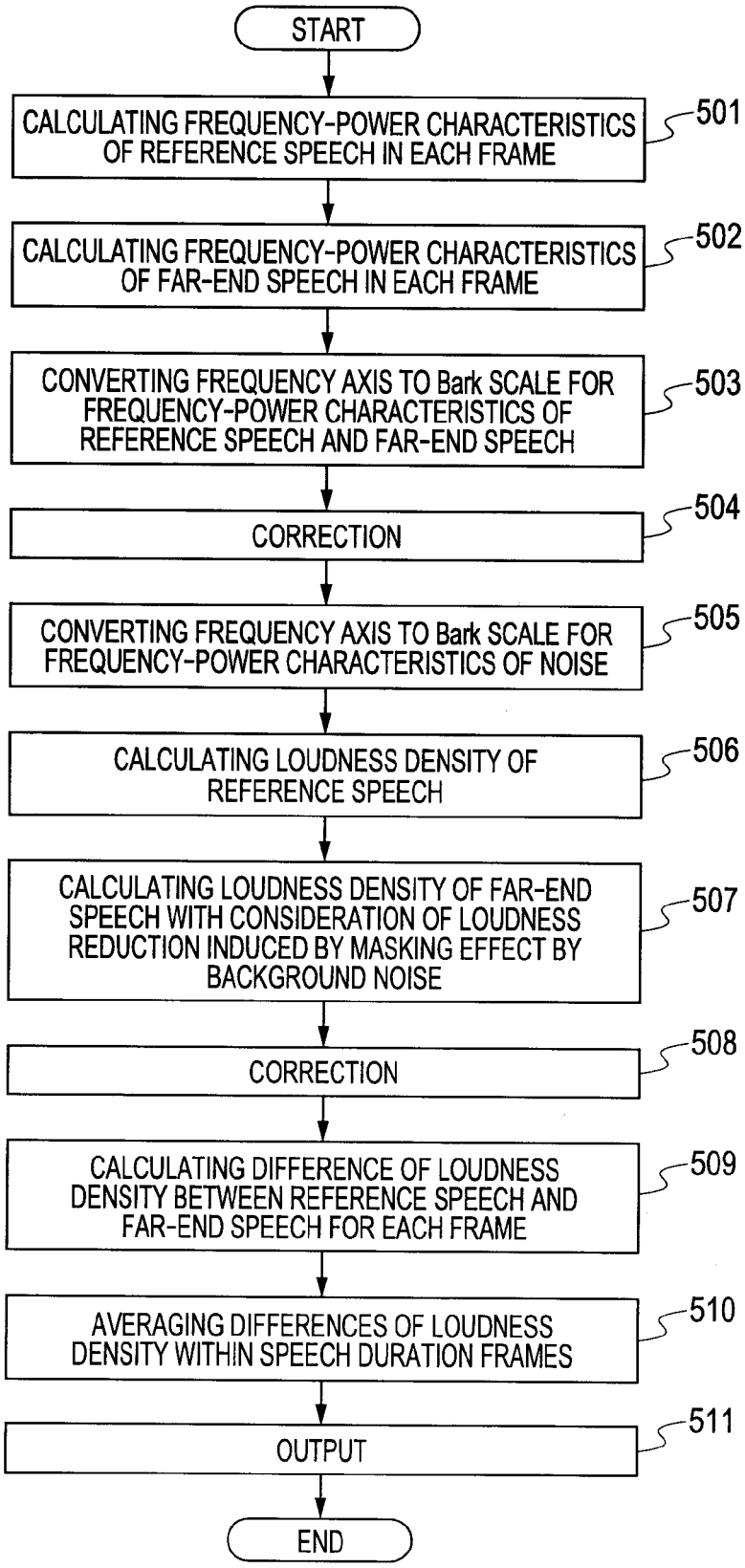
FIG. 5 is a diagram showing a processing flow of a speech distortion calculation unit according to a third embodiment of the present invention.

Subtraction of Frequency-Power Characteristics Taking Loudness Scale into Account FIG. 5 shows a method of calculating the speech distortion which is conducted by the calculating method taking the loudness scale into account, in a process of subtracting the frequency-power characteristics of the far-end speech.

In Step 501, the frequency-power characteristics of the reference speech in each frame are calculated. This method is identical with that in Step 301.

In Step 502, the frequency-power characteristics of the far-end speech for each frame are calculated. This method is identical with that in Step 302.

In Step 503, the frequency axis is converted to the Bark scale for the frequency-power characteristics of the reference speech obtained in Step 501, and the frequency-power characteristics of the far-end speech obtained in Step 502. This method is identical with the method described with reference to Step 401, and its description will be omitted. As a result of calculation, the frequency-power characteristics $Pbx_i[j]$ and $Pby_i[j]$ (i: frame No., j: frequency band No.) of the reference speech and the far-end speech on the Bark scale are obtained.

In Step 504, a correcting process such as normalization of the power, smoothing of the time frame direction, and smoothing of the frequency direction is conducted. This process uses the same method as the method in Steps 306 and 307. Also, the process may be changed as necessary. The resultantly obtained frequency-power characteristics of the reference speech and the far-end speech on the Bark scale are presented by $Pbx'_i[j]$ and $Pby'_i[j]$.

In Step 505, the frequency axis of the noise for the frequency-power characteristics, which has been output by the noise characteristic calculation unit 230 is converted to the Bark scale. This calculation is identical with that in Step 402. As a result, the noise characteristics PbNA [i,j] corresponding to the i-th weighting unit and the j-th frequency band are obtained.

In Step 506, the loudness density of the reference speech is calculated. In calculation of the loudness density, an expression shown in Expression (15) by Zwicker et al may be used. However, in this example, the expression by Lochner et al representing the loudness when the background noise exists is used. The expression by Lochner et al is disclosed by the following document.

J. P. A. Lochner, J. F. Burger: "Form of the loudness function in the presence of masking noise," Journal of the Acoustical Society of America, vol. 33, no. 12, pp. 1705-1707 (1961)

According to this document, the following Expression is established among a power Ie of the noise in a certain frequency band, a power Ip of the physiological noise which determines the hearing threshold in the frequency band, a power I of a pure tone in the frequency, and a loudness ψ of the pure tone which is perceived by the person.

$$\psi=K(I^n-(Ip+Ie)^n) \tag{25}$$

where K and n are constants.

Based on this Expression, the loudness density $Lx_i[j]$ of the reference speech corresponding to the i-th frame and the j-th frequency band is calculated as follows.

$$Lx_i[j]=K((Pbx_i'[j])^n-(Ip[j])^n) \tag{26}$$

In this expression, the power Ie of the background noise is set to 0. Ip[j] is a physiological noise power that determines the hearing threshold of the j-th frequency band, and is obtained through a measurement experiment of the hearing threshold, separately. As a value of Ip[j], the power of the hearing threshold in a band of the j-th frequency bin can be used. When a value of $Lx_i[j]$ is negative, the value is set to 0.

In Step 507, the loudness density of the far-end speech is calculated. In this situation, the loudness density is calculated taking the degree of a reduction of the loudness which is caused by the frequency-power characteristics of the noise obtained in Step 505 into account. More specifically, the loudness density $Ly_i[j]$ of the far-end speech corresponding to the i-th frame and the j-th frequency band is calculated using Expression (27) as follows.

$$Ly_i[j]=K((Pby_i'[j])^n-(Ip[j]+PbNA[k,j])^n) \tag{27}$$

where k is No. of the weighting unit. As a result of Expression (27), when $Ly_i[j]$ is a negative value, $Ly_i[j]$ is changed to the following value.

$$Ly_i[j]=K(f_kPby_i'[j])^n \tag{28}$$

where $f_k$ is a flooring coefficient corresponding to the k-th weighting unit 240.

As an expression for calculating $Ly_i[j]$, a criterion for selecting any one of Expressions (27) and (28) may be a criterion other than the above-mentioned one. For example, there is a method in which a value on a right side of Expression (27) is compared with a value on a right side of Expression (28), and a larger value is used as $Ly_i[j]$. Also, Expression (28) may be replaced with Expression (29).

$$Ly_i[j]=K((f_kPby_i'[j])^n-(Ip[j])^n) \tag{29}$$

When both of Expression (28) and Expression (29) are 0 or lower, a value of $Ly_i[j]$ is set to 0.

In Step 508, the loudness density obtained in Step 507 is corrected. The correction may be conducted as necessary. For example, an added value obtained by adding the loudness densities $Lx_i[j]$ of the reference speech obtained in Step 506 for all of the frame Nos. (i) and all of the frequency band Nos. (j) is calculated. Likewise, an added value obtained by adding the loudness densities $Ly_i[j]$ of the far-end speech obtained in Step 507 for all of the frame Nos. (i) and all of the frequency band Nos. (j) is calculated. Finally, a coefficient obtained by dividing the added value of the reference speech by the added value of the far-end speech is calculated, and the loudness density $Ly_i[j]$ of the far-end speech is multiplied by the coefficient thus calculated. As a result, total values of the loudness of the reference speech and the far-end speech are so normalized as to match each other.

In Step 509, a difference of the loudness density between the reference speech and the far-end speech in each frame is calculated. The calculation is identical with that in Step 309. As a result, a loudness difference Di of the i-th frame is obtained.

In Step 510, an average value of the loudness difference within the speech duration is obtained from the loudness difference of each frame obtained in Step 509, and the average value is set as speech distortion. This method is identical with that in Step 310. As a result, a speech distortion $D_{total}$ is obtained.

The method of outputting the predicted subjective evaluation score from the obtained speech distortion has been already described, and therefore its description will be omitted hereinafter.

When the method of calculating the speech distortion is used, subtraction of the power characteristics taking the loudness which is loudness really felt by the person into account is conducted. Therefore, calculation of the subjective opinion score more along the perception of the human can be conducted.

The calculation of the loudness densities of the reference speech and the far-end speech which have been conducted in Steps 506 and 507 can be conducted by another method. There has been known from the knowledge of an auditory psychology that an absolute threshold of sound when a background noise exists increases by a power of the background noise that exists in the critical band filter including a frequency of the sound. First, the calculation of the loudness density $Lx_i[j]$ of the reference speech in Step 506 is conducted by Expression (15). Then, the loudness density $Ly_i[j]$ of the far-end speech in Step 507 is calculated by the following Expression.

$$Ly_i[j] = S_l\left(\frac{P_0[j]+PbNA[k,j]}{0.5}\right)^{\gamma}\left(\left(0.5+0.5\frac{Pbys_i'[j]}{P_0[j]+PbNA[k,j]}\right)^{\gamma}-1\right) \tag{30}$$

where i is frame No., and j is No. of the frequency band. k is No. of the weighting unit. That is, PbNA[k,j] is added to the hearing threshold $P_0[j]$ as an increment of the threshold value due to the power of the noise. PbNA[k,j] used in this expression is a value calculated by the noise characteristic calculation unit 230. Alternatively, the noise characteristics calculated taking the critical band filter described above into account may be used. This can lead to such an advantage that the loudness is more reduced as more noise exists.

The subtracting process taking the loudness scale into account can be realized not depending on the flowchart of FIG. 5, but by changing the subtracting method of Step 303 in the flowchart of FIG. 3.

In the calculation in Step 303, the power $Pys_i[k]$ (i: frame No., k: frequency bin No.) of the far-end speech after the subtracting process is calculated by Expression (7). In this example, the calculation is changed to calculation of $Pys_i[k]$ for establishing the following Expression on the basis of the expressions of loudness by Lochner et al.

$$K((Py_i[k])^n-(Ip[k]+PNA[j,k])^n)=K((Pys_i[k])^n-(Ip[k])^n) \quad (31)$$

here $Py_i[k]$ is a power of the far-end speech in the case of frame No. i and frequency bin No. k, and PNA[j,k] is a power of the noise corresponding to the k-th frequency bin output by the j-th weighting unit 240. Ip[k] is a physiological noise power that determines the hearing threshold in the frequency band of the k-th frequency bin as in the above-mentioned power, which is a value obtained through the measurement experiment of the hearing threshold. As a value of Ip[k], the power of the hearing threshold in the band of the k-th frequency bin can be used. K and n are constants. Through this expression, $Pys_i[k]$ is obtained by the following Expression.

$$Pys_i[k]=((Py_i[k])^n-(Ip[k]+PNA[j,k])^n+(Ip[k])^n)^{1/n} \quad (32)$$

Also, when a value in parenthesis which is to be subjected to calculation of an n-th root on a right side of Expression (32) is negative, $Pys_i[k]$ is calculated by Expression (8).

As an expression for calculating $Pys_i[k]$, a criterion for selecting any one of Expressions (32) and (8) may be a criterion other than the above-mentioned one. For example, there is a method in which the value on the right side of Expression (32) is compared with the value on the right side of Expression (8), and a larger value is used as $Pys_i[k]$.

According to this method, the power of the far-end speech taking the degree of a reduction of the loudness due to the noise into account is calculated.

The respective processing described above can be implemented even in combination. For example, in the above description, the power equivalent to that when the loudness is reduced due to the noise is calculated through Expressions (31) and (32) based on the loudness calculation expressions of Lochner. This method can be changed to calculation conducted by a method based on the loudness calculation expression of Expression (30). More specifically, first, the loudness $Ly_i[i]$ under the noise influence is calculated by Expression (30). Then, a power $Pbys'_i[j]$ of the far-end speech when the $Ly_i[j]$ is obtained is calculated by Expression (16). Processing is advanced to Step 304 with the $Pbys'_i[j]$ as the power of the far-end speech. In the processing in Step 304 described above, the powers of the reference speech and the far-end speech are obtained for each frequency bin. On the other hand, in this modification, the power of the far-end speech is obtained for each band on the Bark scale. For that reason, the normalizing process in Step 304 can be implemented by a method in which normalization is conducted after the power of the reference speech is converted to the frequency-power characteristics on the Bark scale, or a method in which normalization is conducted after the power of the far-end speech is converted to a value for each frequency bin.

Fourth Embodiment

Subtraction of Loudness

It is conceivable that the process of subtracting the noise characteristics from the far-end speech is achieved by not only a method based on the frequency-power characteristics, but also a method based on the loudness density. Those methods will be described with reference to a flowchart of FIG. 6.

The initial processing is identical with that in Steps 510 to 505 of FIG. 5, and therefore their description will be omitted.

In Step 601, the noise characteristics PbNA[k, j] (k: No. of the weighting unit, J: frequency band No.) obtained in Step 505 is converted to the loudness density according to Expression (15). That is, the loudness density LN[k,j] of the noise in the k-th weighting unit and the j-th frequency band is obtained by the following Expression.

$$LN[k,\ j] = S_i\left(\frac{P_0[j]}{0.5}\right)^{\gamma}\left(\left(0.5+0.5\frac{PbNA[k,\ j]}{P_0[j]}\right)^{\gamma}-1\right) \quad (33)$$

The respective constants in this Expression are identical with those in Expression (15). When LN[k,j] is negative, LN[k,j] is set to 0.

In Steps 602 and 603, the loudness density of the reference speech and the loudness density of the far-end speech are calculated, respectively. This method can be achieved by the method in Step 308. That is, the respective loudness densities $Lx_i[j]$ and $Ly_i[j]$ of the reference speech and the far-end speech are calculated from the respective frequency-power characteristics $Pbx'_i[j]$ and $Pby'_i[j]$ (i: frame No., j: frequency band No.) of the reference speech and the far-end speech, which have been obtained in the above-mentioned steps, as follows.

$$Lx_i[j] = S_i\left(\frac{P_0[j]}{0.5}\right)^{\gamma}\left(\left(0.5+0.5\frac{Pbx'_i[j]}{P_0[j]}\right)^{\gamma}-1\right) \quad (34)$$

$$Ly_i[j] = S_i\left(\frac{P_0[j]}{0.5}\right)^{\gamma}\left(\left(0.5+0.5\frac{Pby'_i[j]}{P_0[j]}\right)^{\gamma}-1\right) \quad (35)$$

When the calculated results of the loudness density are negative, the results are set to 0.

In Step 604, the loudness density of the noise is subtracted from the loudness density of the far-end speech. That is, the loudness density $Ly'_i[j]$ of the far-end speech after subtraction is obtained by the following expression.

$$Ly_i'[j]=Ly_i[j]-LN[k,j] \quad (36)$$

When Expression (36) is a negative value, the loudness density $Ly'_i[j]$ is calculated by the following expression.

$$Ly_i'[j]=f_kLy_i[j] \quad (37)$$

where k is No. of the weighting unit, and fk is a flooring coefficient corresponding to the k-th weighting unit.

As an expression for calculating $Ly'_i[j]$, a criterion for selecting any one of Expressions (36) and (37) may be a criterion other than the above-mentioned one. For example, there is a method in which a value on a right side of Expression (36) is compared with a value on a right side of Expression (37), and a larger value is used as $Ly'_i[j]$.

In Step 605, the calculated loudness density is corrected. For example, for normalization, an added value obtained by adding the loudness densities $Lx_i[j]$ of the reference speech obtained in Step 602 for all of the frame Nos. (i) and all of the frequency band Nos. (j) is calculated. Likewise, an added value obtained by adding the loudness densities $Ly'_i[j]$ of the far-end speech after the noise characteristics have been subtracted, which have been obtained in Step 604, for all of the frame Nos. (i) and all of the frequency band Nos. (j) is calculated. Finally, a coefficient obtained by dividing the added value of the reference speech by the added value of the far-end speech is calculated, and $Ly_i[j]$ is multiplied by the coefficient thus calculated. As a result, total values of the loudness of the reference speech and the far-end speech are so normalized as to match each other. The normalizing method may be appropriately changed to another method as necessary.

Thereafter, processing equivalent to that in Step 509 (that is, 309) in FIG. 5 is conducted. That is, a difference of the loudness density between the reference speech and the far-end speech for each frame is calculated. This calculation is conducted according to Expression (17), and the loudness density $Ly_i[j]$ of the far-end speech in Expression (17) is substituted with $Ly'_i[j]$ which is the loudness density after the subtracting process has been conducted.

The subsequent processing is identical with that described above, and therefore its description will be omitted.

According to this method, because the loudness of the noise is used for subtraction, distortion calculation close to the feeling of the person can be conducted.

CONCLUSION

As has been described above in the embodiments, in the speech quality evaluation of the phone speech, the process of subtracting the physical quantity of the background noise from the physical quantity of speech is applied so that the characteristics of speech listening under the noise environment can be simulated. As a result, the speech quality evaluation can be predicted with high precision under the noise environment.

Also, the plural noise reducing processes are used in combination, thereby enabling the predicted values corresponding to the plural scales for subjective evaluation to be obtained.

SUPPLEMENTAL

Although having not been described in the above embodiments, speech data filtered by a band-pass filter of the phone band may be input to the reference speech and the degraded speech input to the speech quality evaluation system of FIG. 2. As a coefficient of such a filter, the coefficient of the IRS filtering disclosed in the above-mentioned document "ITU-T Recommendation P. 861" can be used.

Figure 6:
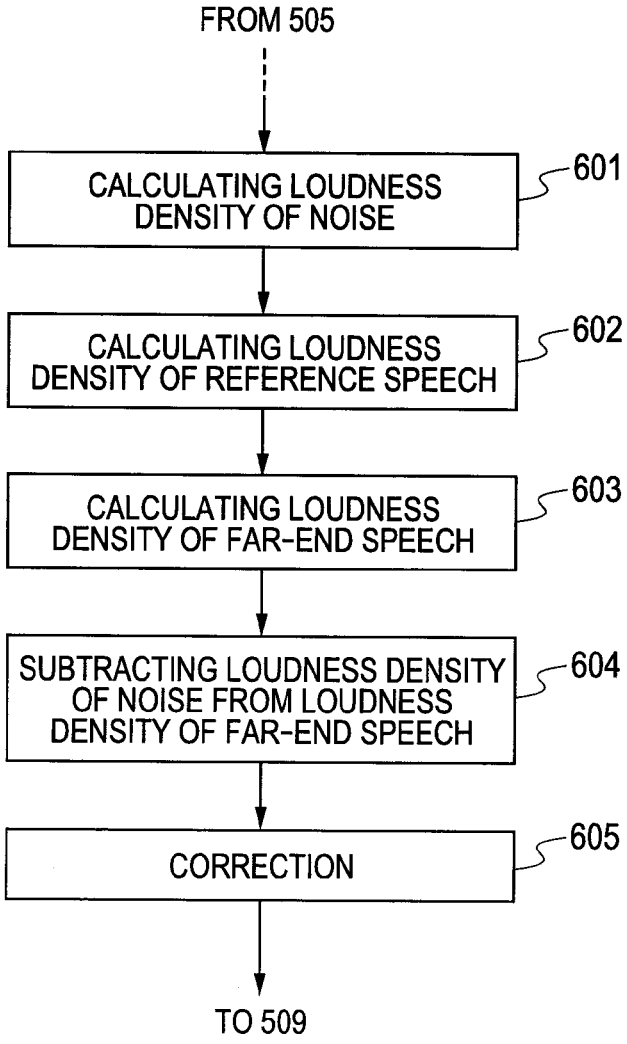
FIG. 6 is a diagram showing a processing flow of a speech distortion calculation unit according to a fourth embodiment of the present invention.

Also, in calculation of the speech distortion described in the above embodiments, the plural processes for adjusting the levels between the reference speech and the far-end speech are used (the level adjustment unit 225 in FIG. 2, Steps 304 and 306 in FIG. 3, Steps 504 and 508 in FIG. 5, and Step 605 in FIG. 6). Those level adjusting processes become necessary or unnecessary depending on which aspect of speech is focused, and therefore can be conducted as necessary.

Also, in the entire processing flow, an order in which the process of subtracting the noise characteristics is conducted is not limited to the order described in the above embodiments. For example, in the flowchart of FIG. 3, Step 303 for the noise characteristic subtraction may be so changed as to be executed after Step 307.

Also, in the method of subtracting the noise characteristics, in the above embodiments, the subtracting method based on the power and the subtracting method based on the loudness density have been described. However, any methods of subtracting the other noise characteristics from the characteristics of speech can be applied.

Also, in the method of calculating the noise characteristics, in the above embodiments, the method taking the critical band filter into account has been also described. The characteristic calculation taking the critical band filter into account may be applied to not only the noise characteristics but also the far-end speech and the reference speech.

Also, the flooring coefficient is a constant value in the above embodiments, but may be changed for each scale for subjective evaluation, or may be changed for each frequency band.

Also, as the weight by which the noise characteristics are multiplied, one value is used for one weighting unit, however, a different value may be used for each frequency or each time.

Also, in the above embodiments, it is assumed that the value obtained by averaging the powers within the silent duration, or the value estimating the power spectrum of the background noise within the speak duration is used. However, a calculating method different from the above calculating method can be used to calculate the noise characteristics. First, not the overall average within the silent duration or the speak duration, but the power spectrum of the background noise in a given time close to the frame of speech to be calculated in distortion can be used. As how to obtain the background noise, when a duration within which the noise characteristics are calculated is the silent duration, the average power can be used. When the duration within which the noise characteristics are calculated is the speech duration, the technique for estimating the background noise described above can be used. This enables the calculation that ignores an influence of the past noise information which has been already forgotten by the person. Also, because the amount of background noise is calculated on the basis of speech in a time close to a frame in question, in subtraction of the noise power of the far-end speech according to the embodiments of the present invention, the characteristics close to the net noise that prevents hearing of the person can be used.

It should be understood by those skilled in the art that various modifications, combinations, sub-combinations, and alterations may occur depending on design requirements and other factors insofar as they are within the scope of the appended claims or the equivalents thereof.

What is claimed is:

1. A speech quality evaluation system that outputs a predicted value of a subjective opinion score for evaluation speech, the system comprising:

a speech distortion calculation unit that conducts a process of subtracting, after frequency-power characteristics of the evaluation speech are calculated, subtraction characteristics, which are the frequency-power characteristics calculated from background noise, from the frequency-power characteristics of the evaluation speech, and calculates a speech distortion based on the frequency-power characteristics after the subtracting process;

a subjective evaluation prediction unit that calculates the predicted value of the subjective opinion score based on the speech distortion; and a weighting unit that generates a plurality of weighted subtraction characteristics corresponding to plural scales for subjective evaluation by multiplying the subtraction frequency-power characteristics by a plurality of weight coefficients that are different from each other, wherein the speech distortion calculation unit generates a plurality of subtracted frequency-power characteristics by subtracting each of the plurality of weighted subtraction characteristics from the frequency-power characteristics of the evaluation speech, and calculates a plurality of speech distortions by comparing each of the plurality of subtracted frequency-power characteristics with frequency-power characteristics of a reference speech, and the subjective evaluation prediction unit calculates predicted values of one or a plurality of subjective opinion scores based on the plurality of speech distortions calculated in the speech distortion calculation unit.

2. The speech quality evaluation system according to claim 1, wherein the reference speech, which is a reference of evaluation, is input, and the speech distortion calculation unit calculates the speech distortion based on a difference between the evaluation speech after the subtracting process and the reference speech.

3. The speech quality evaluation system according to claim 1, wherein the subjective evaluation prediction unit calculates the predicted values of the plurality of subjective opinion scores by using a conversion expression with the plurality of speech distortions as variable.

4. The speech quality evaluation system according to claim 1, wherein the subtracting process in the speech distortion calculation unit is conducted based on a calculated value of loudness of speech, and conducts calculation so that the loudness of a given frequency characteristic is subtracted from loudness of the evaluation speech.

5. The speech quality evaluation system according to claim 1, wherein the subtracting process in the speech distortion calculation unit subtracts frequency-power characteristics of noise from frequency-power characteristics of the evaluation speech.

6. The speech quality evaluation system according to claim 1, wherein the subtracting process in the speech distortion calculation unit subtracts frequency-power characteristics on the Bark scale of noise from frequency-power characteristics on the Bark scale of the evaluation speech.

7. The speech quality evaluation system according to claim 1, wherein the frequency characteristics used in the subtracting process in the speech distortion calculation unit is frequency characteristics of the evaluation speech in a time duration close to a time to be calculated.

8. The speech quality evaluation system according to claim 1, wherein the evaluation speech is a far-end speech pronounced from a phone.

9. The speech quality evaluation system according to claim 1, further comprising a noise characteristics calculation unit that obtains the frequency characteristics of the evaluation speech in a silence duration, wherein the speech distortion calculation unit uses the frequency characteristics of the evaluation speech in the silence duration as the frequency characteristics used in the subtracting process.

10. The speech quality evaluation system according to claim 1, further comprising a noise characteristics calculation unit that obtains the frequency characteristics of a background noise included in the evaluation speech in a speech duration, wherein the speech distortion calculation unit uses the frequency characteristics of the background noise in the speech duration as the subtraction characteristics used in the subtracting process.

11. The speech quality evaluation system according to claim 1, wherein in the speech distortion calculation unit, the frequency characteristics used for the subtracting process are frequency characteristics for subtraction which are input to the speech quality evaluation system.

12. A non-transitory storage medium readable by a computer, the storage medium storing a program of instructions executable by the computer to perform a function as a speech quality evaluation system that outputs a predicted value of a subjective opinion score for an evaluation speech, the function comprising:

calculating frequency-power characteristics of the evaluation speech;

generating a plurality of weighted subtraction characteristics corresponding to plural scales for subjective evaluation by multiplying subtraction frequency-power characteristics, which are calculated based on background noise, by a plurality of weight coefficients that are different from each other;

generating a plurality of subtracted frequency-power characteristics by subtracting each of the plurality of weighted subtraction characteristics from the frequency-power characteristics of the evaluation speech;

calculating a plurality of speech distortions by comparing each of the plurality of subtracted frequency-power characteristics with frequency-power characteristics of a reference speech; and calculating predicted values of one or a plurality of subjective opinion scores based on the plurality of calculated speech distortions.

* * * * *